US005960557A

United States Patent [19]

Sather

[11] Patent Number: 5,960,557

[45] Date of Patent: Oct. 5, 1999

[54] PIPING SYSTEM AND METHOD FOR PULP DRYERS

[76] Inventor: Stanley H. Sather, 894 Citadel Drive, Port Coquitlam, British Columbia, Canada, V3C 5Y1

[21] Appl. No.: 08/975,252

[22] Filed: Nov. 21, 1997

[51] Int. Cl.[6] ..... F26B 3/00

[52] U.S. Cl. ..... 34/449; 34/122; 34/124

[58] Field of Search ..... 34/443, 448, 449, 34/454, 122, 124; 165/110, 111

[56] References Cited

U.S. PATENT DOCUMENTS

| | | | |
|---|---|---|---|
| 1,925,847 | 9/1933 | Prentice . | |
| 2,278,086 | 3/1942 | Lea . | |
| 2,587,720 | 3/1952 | Fritzberg . | |
| 3,026,092 | 3/1962 | Pellegrini . | |
| 4,909,309 | 3/1990 | Palfalvi et al. . | |
| 5,383,288 | 1/1995 | Ilmarinen | 34/124 X |
| 5,782,293 | 7/1998 | Sather . | |

FOREIGN PATENT DOCUMENTS

| | | |
|---|---|---|
| 2096262 | 11/1994 | Canada . |
| 2040827 | 7/1995 | Canada . |
| 533858 | 12/1939 | United Kingdom . |
| 549365 | 5/1942 | United Kingdom . |
| 962753 | 7/1964 | United Kingdom . |

*Primary Examiner*—Henry Bennett
*Assistant Examiner*—Steve Gravini
*Attorney, Agent, or Firm*—Norman M. Cameron

[57] ABSTRACT

A steam distribution and condensate recovery system for pulp dryers has a plurality of steam heat exchangers. The system includes a steam feed conduit adjacent one end of each heat exchanger. A condensate conduit is adjacent the one end of each heat exchanger. A first connecting conduit is positioned adjacent the one end of each heat exchanger and connects each heat exchanger to the steam feed conduit. A second connecting conduit is placed adjacent the one end of each heat exchanger and connects each heat exchanger to the condensate conduit. Preferably the connecting conduits includes expansion loops. The expansion loops extend away from heat exchanger and away from access doors adjacent each heat exchanger.

10 Claims, 7 Drawing Sheets

PIPING SYSTEM AND METHOD FOR PULP DRYERS

BACKGROUND OF THE INVENTION

This invention relates to piping systems for pulp dryers and methods for piping heat exchangers thereof.

Pulp dryers commonly use a plurality of blow boxes to dry moving, continuous webs of wood pulp with hot air. The hot air is circulated by means of a plurality of fans. The air is heated, typically by steam heat exchangers or "steam coils" assembled in vertical banks, before the air is directed onto the web of pulp.

In one common arrangement, a plurality of fans arc vertically-spaced apart. There is a pair of spaced-apart heat exchanger banks on each side of each fan. Each bank has several heat exchangers. There is an access door between each such pair of heat exchangers. The air moves towards the access door between the heat exchangers. The air then splits into two streams and moves through the heat exchangers which are positioned to each side of the door. Each such steam changes direction again and passes through one of the fans which blows the air towards the blow boxes and onto the web.

Conventionally the heat exchangers are connected to two vertical conduits in each bank which extend between each vertically-spaced apart set of heat exchangers. There is a first connecting conduit connecting each heat exchanger to a steam feed conduit which feeds steam to each heat exchanger. There is a second connecting conduit connecting each heat exchanger to a condensate conduit which carries away condensate and steam from each heat exchanger.

Conventionally the steam feed conduit and the condensate conduit are positioned adjacent the sides of the heat exchanger which receive the stream of air or discharge the heated air. Likewise the connecting conduits usually extend over these sides of each heat exchanger as well. Thus the conduits partially block the stream of air and reduce the efficiency of each heat exchanger.

Furthermore, the positions of the conduits interfere with servicing of the heat exchangers. For example, each heat exchanger typically has a screen accessible through the access door. The conduits extend over the screens, making cleaning, removal and replacement of the screens more difficult. Similarly, the conduits interfere with removal and replacement of the heat exchangers themselves.

Referring to FIG. 1, this shows a portion of a conventional pulp dryer according to the prior art. Each such pulp dryer has a plurality of fans 10, each powered by a motor 12. The air is heated by a steam heat exchanger or steam coil 14 which is equipped with a screen 16. There is a similar heat exchanger on the opposite side of the fan (not shown). The steam coils are arranged in spaced-apart pairs, another such heat exchanger being positioned to the right of the one shown in FIG. 1. Air passes between the heat exchangers as indicated by arrow 18. The air then splits into two portions, one portion moving through heat exchanger 14 as indicated by arrows 20 and 22. The air is directed by the fan toward the blow boxes which provide air to the pulp web as indicated by arrow 23.

The conventional piping arrangement shown in FIG. 1 includes a plurality of condensate conduits 24 which extend vertically. These receive condensate from heat exchanger 14 and a plurality of heat exchangers similar to heat exchanger 14 positioned above and below heat exchanger 14. Similarly, a steam feed conduit 26 extends vertically and is used to provide steam to each of the vertically spaced-apart heat exchangers including heat exchanger 14.

There is a first connecting conduit 30 which connects the steam feed conduit 26 to the heat exchanger. Conduit 30 includes an elongated pipe 32 and connecting flanges 34. Likewise there is second connecting conduit 36 which connects heat exchanger 14 to condensate conduit 24. This includes an elongated conduit 38 and flanges 40. These conduits 28 and 30 connect to opposite ends of the heat exchanger. In other prior art heat exchangers one or both conduits connect midway between the ends.

There is an access doorway 42 in front of the heat exchanger 14 which is normally closed by a door. This provides access to heat exchanger 14 as well as a similar heat exchanger located to the right of heat exchanger 14, but not shown. It may be seen that the position of the condensate conduit 24 and second connecting conduit 36, particularly elongated conduit 38 thereof, interfere with access to screen 16 and heat exchanger 14. This makes it difficult to remove or replace the screen or the heat exchanger. Also the condensate conduit 24, connecting conduit 36, steam feed conduit 26 and connecting conduit 32 all interfere with air flow through the heat exchanger. Workers entering the doorway are exposed to hot steam pipes with this configuration.

Accordingly, there is a need for a more efficient piping system for pulp dryers which does not interfere with air flow through the heat exchangers and allows easy access to the heat exchangers and screens thereof by personnel entering through the access doors.

SUMMARY OF THE INVENTION

According to one aspect of the invention, there is provided a steam distribution and condensate recovering system for pulp dryers having a plurality of steam heat exchangers. The system includes a steam feed conduit adjacent one end of each said heat exchanger. There is a condensate conduit adjacent said one end of each heat exchanger. A first connecting conduit is adjacent said one end of each heat exchanger and connects each said heat exchanger to the steam feed conduit. There is a second connecting conduit adjacent said one end of said each heat exchanger to the condensate conduit.

Each connecting conduit preferably includes an expansion loop to avoid stressing the heat exchanger connections. The expansion loop may extend away from each heat exchanger.

Each heat exchanger may have a second end opposite the first end, a first side and a second side opposite the first side. Air passes through each heat exchanger from the first side to the second side. The expansion loops may extend away from each heat exchanger and said first said end thereof so as not to interfere with air flow towards the first side or away from the second side.

According to another aspect of the invention, there is provided a pulp dryer including a plurality of air circulation fans, each said fan having two spaced-apart said heat exchangers to each side thereof. Air moving towards each said fan passes between the two spaced-apart heat exchangers and through one of the two spaced-apart heat exchangers closest to each said fan. There is a steam distribution and condensate recovery system including a steam feed conduit adjacent one end of each said heat exchanger. The condensate conduit is adjacent said one end of each heat exchanger. A first connecting conduit is adjacent said one end of each heat exchanger connecting said each heat exchanger to the steam feed conduit. A second connecting conduit is adjacent said one end of each heat exchanger, connecting said each heat exchanger to the condensate conduit.

A further aspect of the invention provides a method of piping pulp drying apparatuses of the type including a plurality of air circulation fans. Each said fan has two or more spaced-apart banks of heat exchangers to each side thereof. Air moving towards each said fan passes between the two spaced-apart heat exchanger banks and passes through one of the two spaced-apart heat exchangers closest to each fan. There is a steam distribution and condensate recovery system including a steam feed conduit adjacent one end of each said heat exchanger. A condensate conduit is positioned adjacent said one end of each heat exchanger. A first connecting conduit is positioned adjacent said one end of said each heat exchanger, connecting said each heat exchanger to the steam feed conduit. The second connecting conduit is positioned adjacent said one end of said each heat exchanger, connecting said each heat exchanger to the condensate conduit.

Preferably each connecting conduit preferably includes an expansion loop. This avoids stressing the weaker flanged conduits, typically of copper, when heat expansion occurs. The expansion loop is positioned to extend away from said each heat exchanger.

DESCRIPTION OF THE PREFERRED EMBODIMENTS

Figure 1:
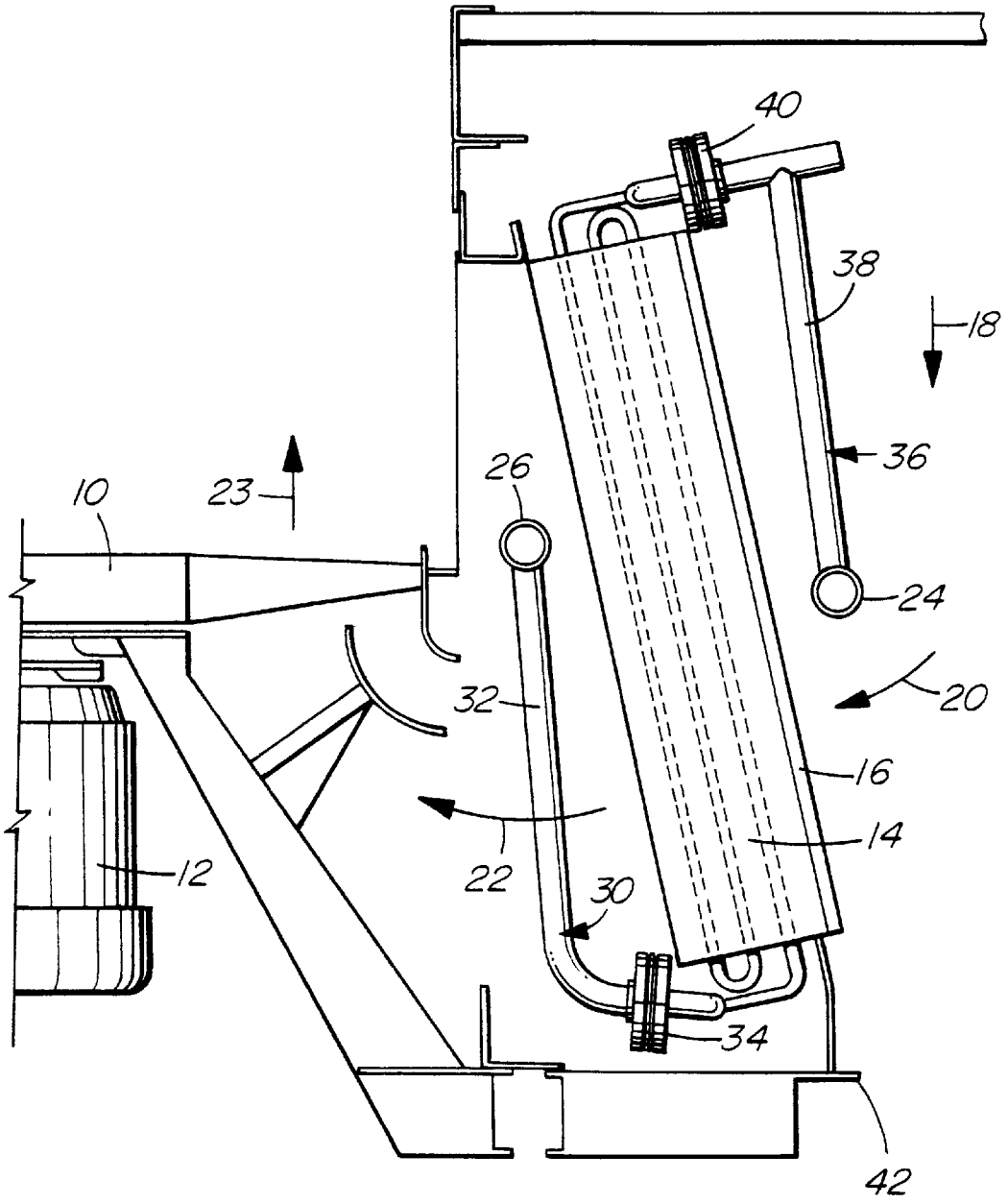
FIG. 1 PRIOR ART
FIG. 1 is a top fragmentary view, showing a circulation fan for a pulp dryer, an adjacent heat exchanger and the piping system thereof.
Figure 2:
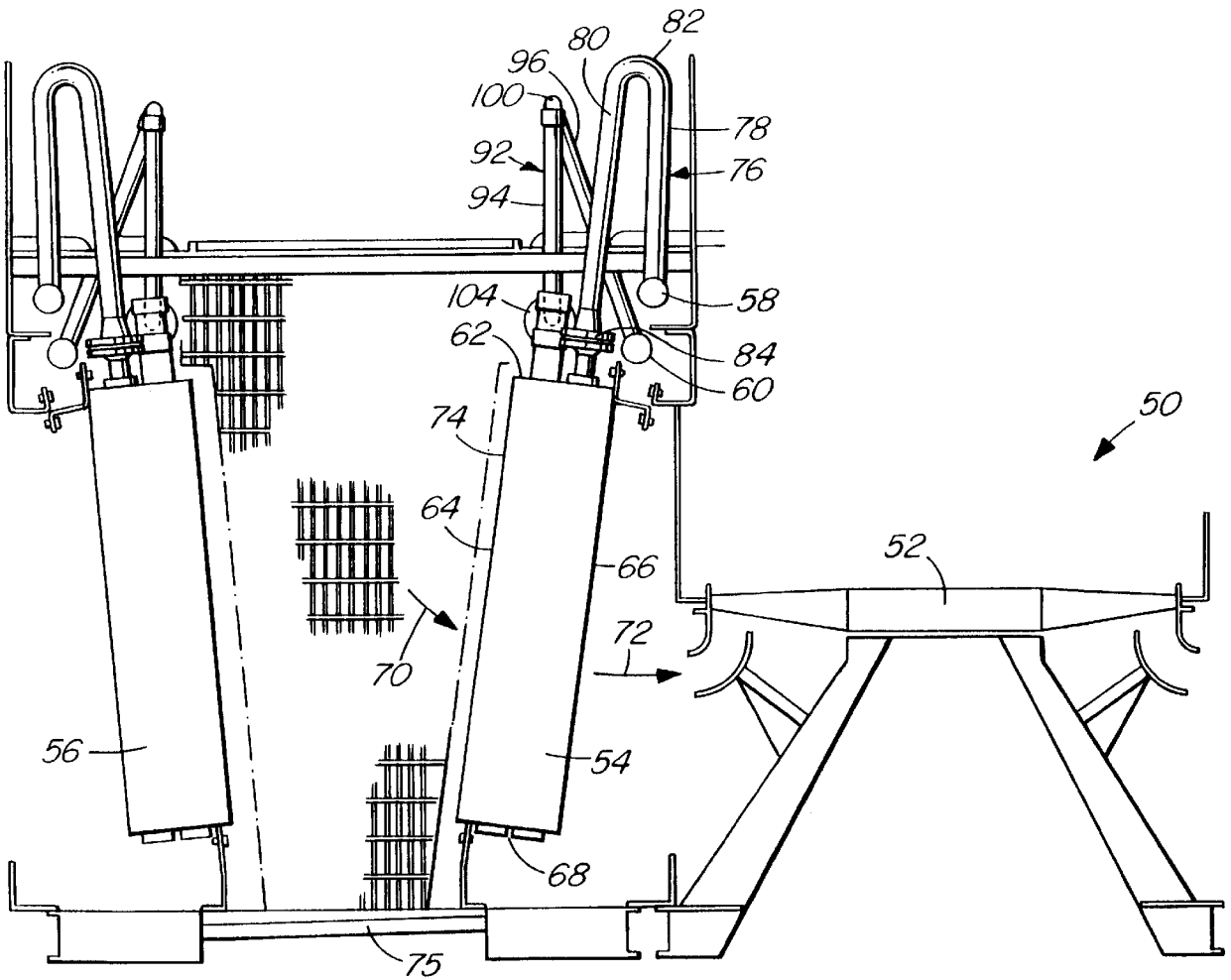
FIG. 2 is a top fragmentary view of a pulp dryer according to an embodiment of the invention showing an air circulation fan, a pair of spaced-apart heat exchangers to one side there of and a piping system therefor.

Referring to FIG. 2, this shows in fragment a pulp dryer 50, according to an embodiment of the invention. This is generally similar to the prior art and includes a fan 52. Each such fan has a pair of heat exchangers on each side thereof, only the pair 54 and 56 on the left side of fan 52 being shown. Heat exchanger 54 is used to heat a portion of the air for fan 52, while heat exchanger 56 is used to heat air for a similar fan to the left of fan 52.

Figure 5:
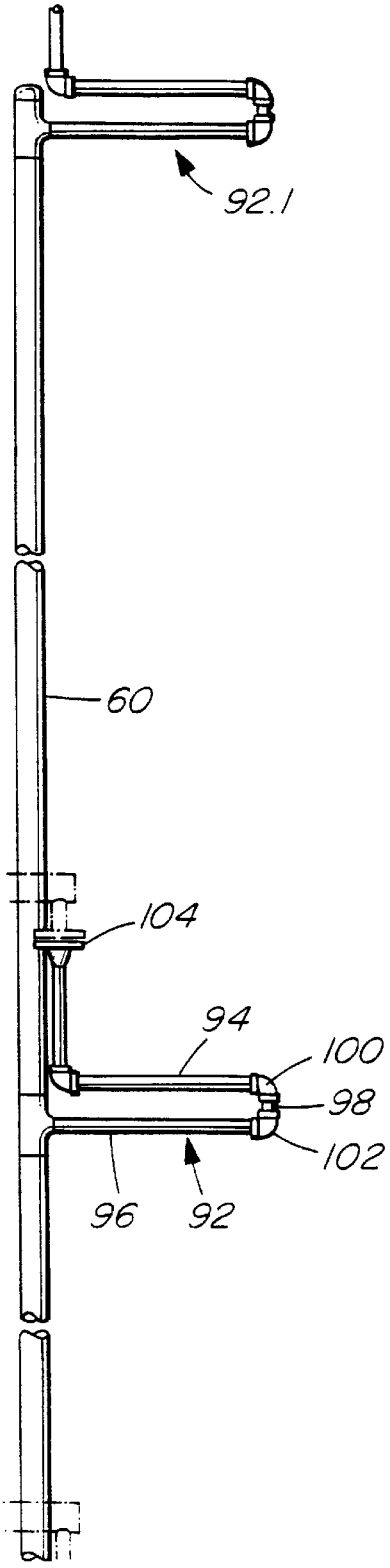
FIG. 5 is a fragmentary side elevation of one of the condensate conduits thereof and the connecting conduits for connection the condensate conduit two heat exchangers.
Figure 6:
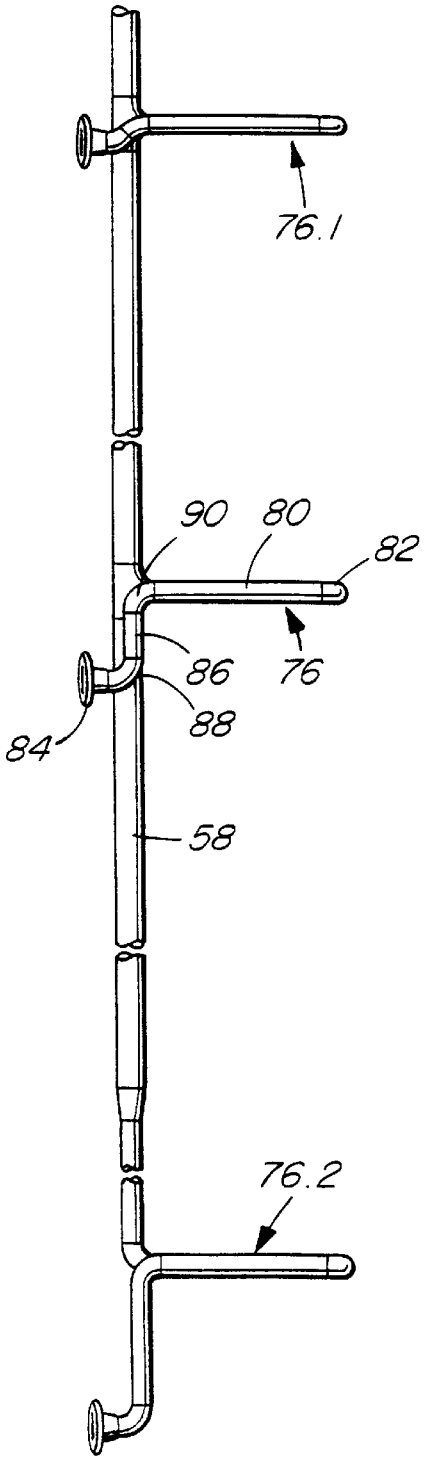
FIG. 6 is a fragmentary side elevation, partly broken away, of the steam feed conduit, thereof and three of the connecting portions of the steam feed conduit to three of the heat exchangers thereof.
Figure 7:
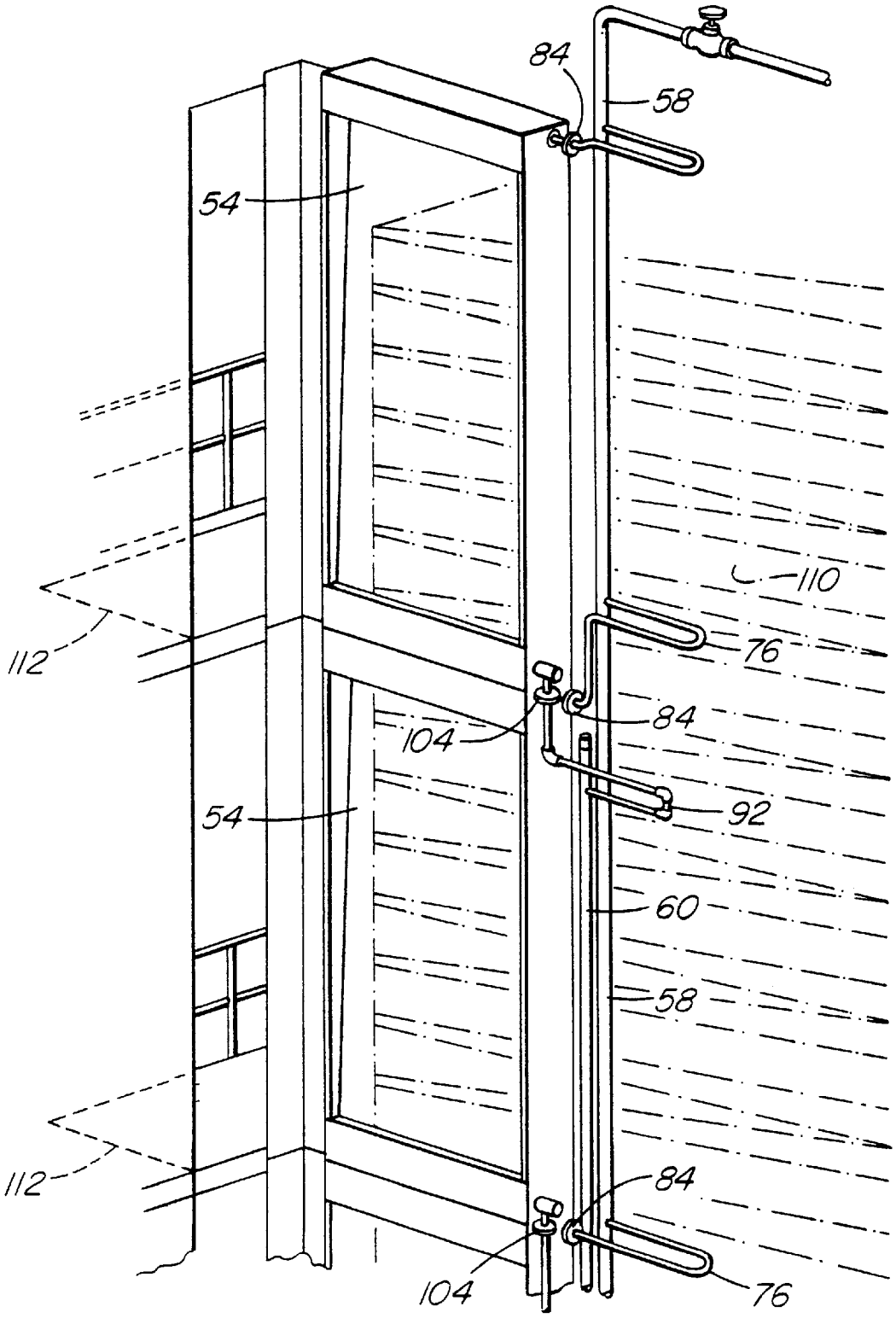
FIG. 7 is a fragmentary view showing two vertically spaced-apart heat exchangers, associated piping and adjacent blow boxes in ghost.
Figure 8:
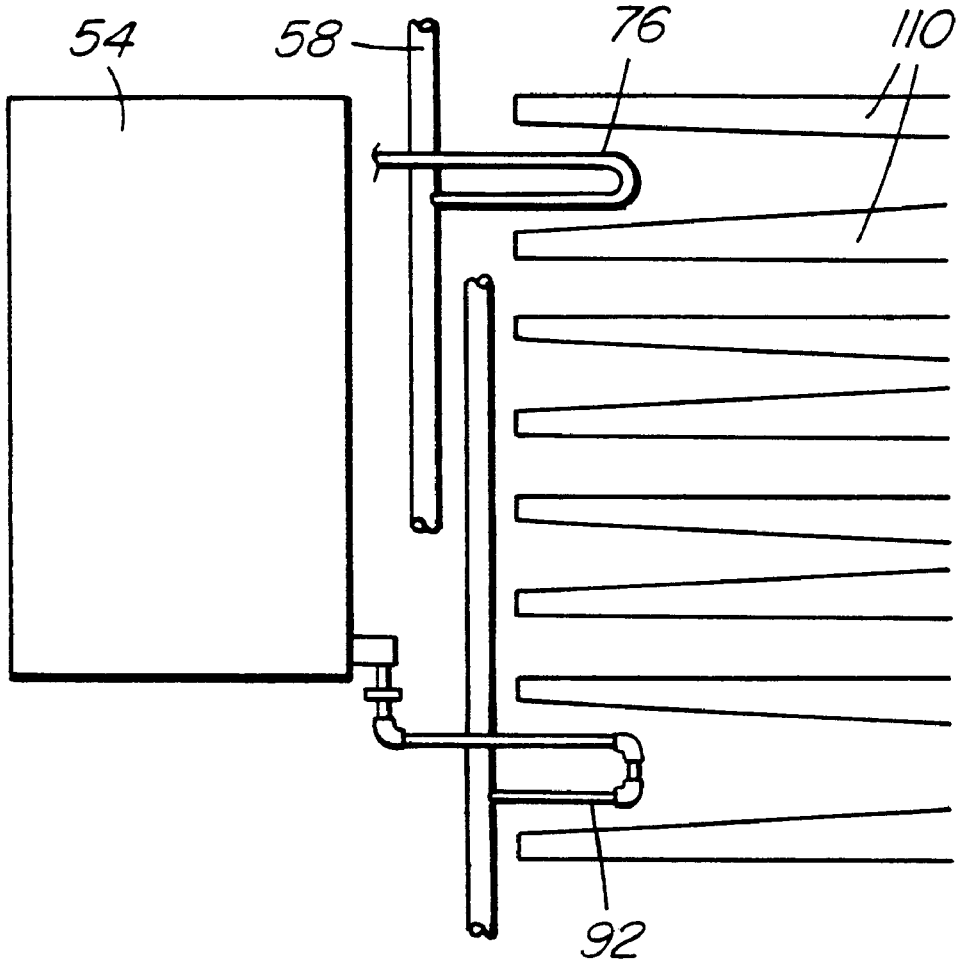
FIG. 8 is a simplified, fragmentary elevation of a heat exchanger, associated piping and adjacent blow boxes.

As with the prior art, there is a steam feed conduit 58, shown in FIG. 2, 4 and 6, which is used to feed steam to heat exchanger 54 as well as similar heat exchangers above and below it. Similarly there is a condensate conduit 60, shown in FIG. 2 and 5, used to collect steam and condensate from heat exchanger 54 as well as the other vertically spaced-apart heat exchangers. Unlike the prior art, however, both headers are located adjacent end 62 of the heat exchanger 54. They are not positioned adjacent its opposite sides 64 and 66 through which air flows. They are displaced away from end 62 in the direction away from its opposite end 68. In this position, the two conduits do not interfere with flow of air through the heat exchanger as indicated by arrows 70 and 72. Likewise they do not interfere with access to heat exchanger 54 or its screen 74 by way of access door 75 between the heat exchanger 54 and its adjacent heat exchanger 56.

There is a third connecting conduit 76 which connects the heat exchanger to the steam conduit 58. This includes, in this example, an expansion loop comprising a pair of straight pipes 78 and 80 which are generally parallel to sides 64 and 66 of the heat exchanger, and a 180° return 82. A pair of flanges 84 connects the first connecting conduit to the heat exchanger. As shown in FIG. 6, there is also a short vertical length of pipe 86 and a pair of elbows 88 and 90 extending between the pipe 80 and flanges 84. The pipe 86 and elbows 88 and 90 are used so the expansion loop can be located within an available space. FIG. 6 also shows a similar connecting conduit 76.1 above conduit 76 and a similar conduit 76.2 below it. These are used for additional heat exchangers similar to heat exchanger 54.

There is also a second connecting conduit 92 which connects the heat exchanger 54 to the condensate conduit 60. This includes an expansion loop comprising two straight lengths of pipe 94 and 96, in this example, which are connected together by a short length of pipe and a pair of elbows 100 and 102 as best shown in FIG. 5. A pair of flanges 104 are used to connect conduit 92 to the heat exchanger. FIG. 5 shows a similar connecting conduit 92.1 used for a heat exchanger above heat exchanger 54.

Figure 3:
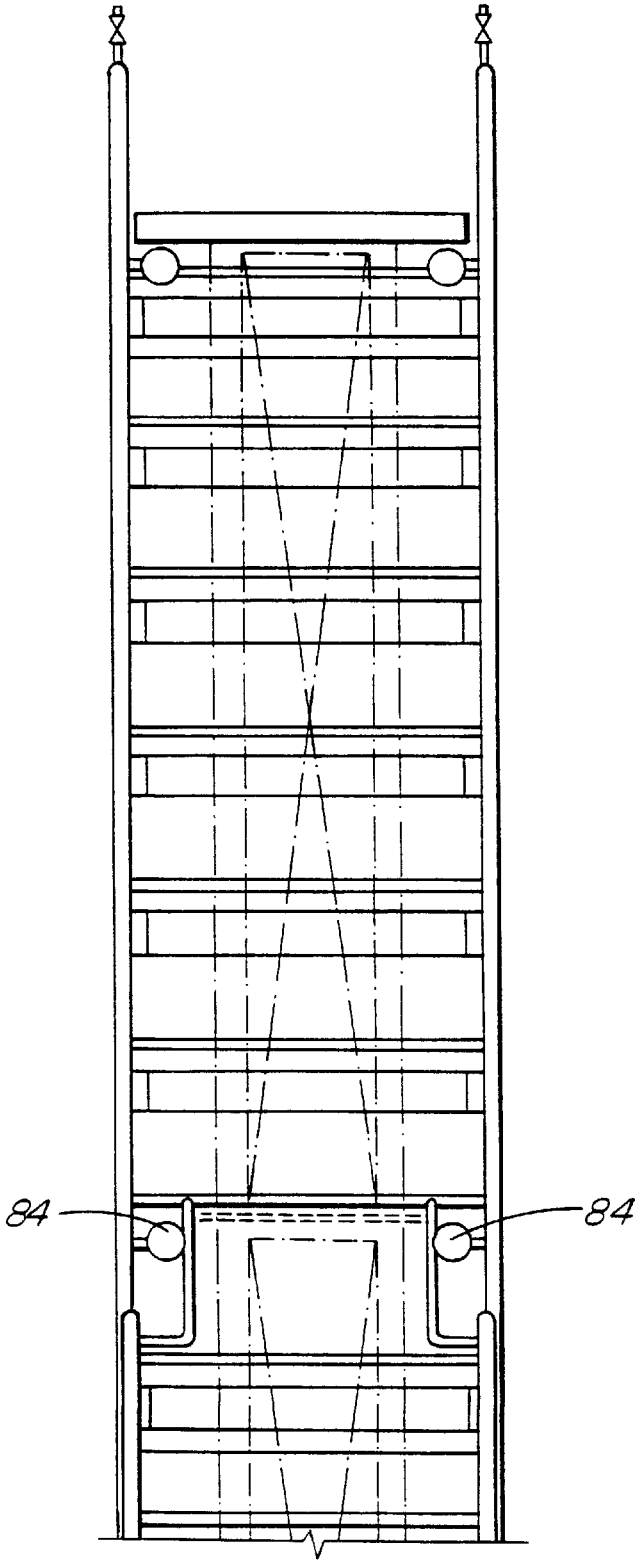
FIG. 3 is a front, fragmentary elevation, partly in section, of a pulp dryer according to an embodiment of the invention as seen through a door thereof.
Figure 4:
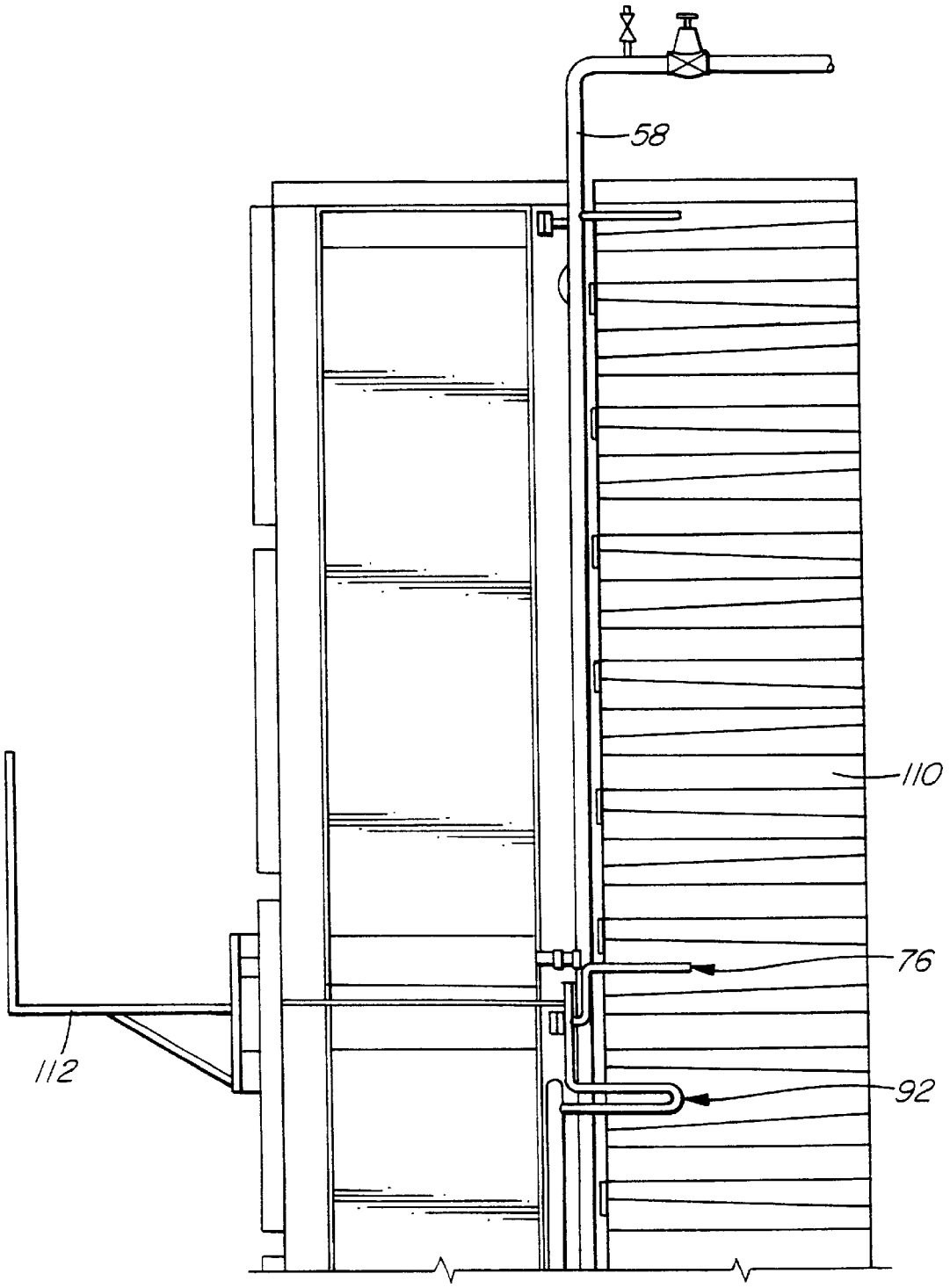
FIG. 4 is a fragmentary side elevation thereof, partly in section.

FIG. 3 and 4 show the general arrangement of the piping including one of the connecting conduits 76 and one of the connecting conduits 92. Portions of a plurality of blow boxes 110 are shown together with a catwalk 112 used for access to each of the fans and heat exchangers at the same level. Catwalks and connecting conduits above and below are omitted.

It will be understood by someone skilled in the art that many of the details provided above are by way of example only and are not intended to limit the scope of the invention which is to be interpreted with reference to the following claims.

What is claimed is:

1. A steam distribution and condensate recovery system for a pulp dryer having a plurality of steam heat exchangers, each said heat exchanger having a first end, a second end opposite the first end, a first side and a second side opposite the first side, air passing through said each heat exchanger from the first side to the second side, the system comprising:

a steam feed conduit adjacent said first end of each said heat exchanger;

a condensate conduit adjacent said first end of each heat exchanger;

a first connecting conduit adjacent said first end of said each heat exchanger connecting said each heat exchanger to the steam feed conduit;

a second connecting conduit adjacent said first end of said each heat exchanger connecting said each heat exchanger to the condensate conduit;

each said connecting conduit including an expansion loop, the expansion loops extending away from said each heat exchanger and said first end thereof, so as not to interfere with air flow towards the first side or away from the second side, the expansion loops of said each heat exchanger including elongated straight members generally parallel to the sides of said each heat exchanger; and a plurality of air circulation fans, each said fan having two spaced-apart said heat exchangers to each side thereof, air moving towards said each fan passing between the two spaced-apart heat exchangers and then through one of the two spaced-apart heat exchangers which is closer to said each fan.

2. A system as claimed in claim 1, wherein the expansion loops are located upstream from the heat exchangers with respect to the air moving towards the heat exchangers.

3. A system as claimed in claim 2, wherein the pulp dryer has an access door between said each two spaced-apart heat exchangers, the second ends of the heat exchangers facing the door and the expansion loops extending away from the access door.

4. A pulp drying apparatus comprising:

a plurality of blow boxes;

a plurality of air circulation fans for circulating air through the blow boxes;

a plurality of steam heat exchangers, each said fan having two spaced-apart said heat exchangers to each side thereof, air moving towards each said fan passing between the two spaced-apart heat exchangers and then through one of the two spaced-apart heat exchangers which is closer to said each fan;

a steam distribution and condensate recovery system including a steam feed conduit adjacent one end of said each heat exchanger, a condensate conduit adjacent said one end of said each heat exchanger; and a first connecting conduit adjacent said one end of said each heat exchanger, connecting said each heat exchanger to the steam feed conduit and a second connecting conduit adjacent said one end of said each heat exchanger, connecting said each heat exchanger to the condensate conduit, each said connecting conduit including an expansion loop, the expansion loops being located upstream from the heat exchangers with respect to the air moving towards the heat exchangers.

5. An apparatus as claimed in claim 4, wherein said each expansion loop extends away from said each heat exchanger and is located between adjacent blow boxes.

6. An apparatus as claimed in claim 5, wherein said each heat exchanger has a second end opposite the one end, a first side and a second side opposite the first side, air passing through said each heat exchanger from the first side to the second side.

7. An apparatus as claimed in claim 6, wherein the expansion loops extend away from said each heat exchanger and said first end thereof, so as not to interfere with air flow towards the first side or away from the second side.

8. An apparatus as claimed in claim 7, wherein the expansion loops of said each heat exchanger include elongate straight members generally parallel to the sides of said each heat exchanger.

9. An apparatus as claimed in claim 4, wherein the pulp dryer has an access door between said each two spaced-apart heat exchangers, the second ends of the heat exchangers facing the door and the expansion loops extending away from the door.

10. A method of piping pulp drying apparatuses of the type comprising a plurality of blow boxes, a plurality of air circulation fans and a plurality of steam heat exchangers, each said fan having two spaced-apart said each heat exchangers to each side thereof, an access door being adjacent said each heat exchanger, air moving towards each said fan passing between the two spaced-apart heat exchangers and then through one of the two spaced-apart heat exchangers which is closer to said each fan, the method comprising:

piping a steam feed conduit adjacent one end of each said heat exchanger which faces away from the door;

piping a condensate conduit adjacent said one end of said each heat exchanger;

piping a first connecting conduit adjacent said one end of each said heat exchanger to connect said each heat exchanger to the steam feed conduit;

piping a second connecting conduit adjacent said one end of said each heat exchanger to connect said each heat exchanger to the condensate conduit;

expansion loops formed on each said connecting conduit, the expansion loops being positioned to extend away from said each heat exchanger and the access doors.

* * * * *